US007621202B2

(12) United States Patent
Bouligny, Jr. et al.

(10) Patent No.: US 7,621,202 B2
(45) Date of Patent: Nov. 24, 2009

(54) METHOD AND APPARATUS FOR FORMING TUBULAR CONNECTIONS

(75) Inventors: Vernon J. Bouligny, Jr., New Iberia, LA (US); Joshua Kyle Bourgeois, Lafayette, LA (US)

(73) Assignee: Frank's Casing Crew & Rental Tool, Inc., Lafayette, LA (US)

( * ) Notice: Subject to any disclaimer, the term of this patent is extended or adjusted under 35 U.S.C. 154(b) by 0 days.

(21) Appl. No.: 12/036,145

(22) Filed: Feb. 22, 2008

(65) Prior Publication Data

US 2008/0202291 A1 Aug. 28, 2008

Related U.S. Application Data

(60) Provisional application No. 60/891,329, filed on Feb. 23, 2007.

(51) Int. Cl.
*B25B 13/50* (2006.01)

(52) U.S. Cl. ..... 81/57.18; 81/57.33

(58) Field of Classification Search ..... 81/57.2, 81/57.16–57.18, 57.21, 57.33, 185
See application file for complete search history.

(56) References Cited

U.S. PATENT DOCUMENTS 3,029,673 A * 4/1962 Mitchell ..... 81/185
5,207,128 A * 5/1993 Albright ..... 81/57.18
5,394,774 A 3/1995 Dlask
5,865,073 A * 2/1999 Wilson et al. ..... 81/57.33
7,237,456 B2 * 7/2007 Neves ..... 81/57.18
2005/0011312 A1 1/2005 Mardian
2006/0011017 A1 1/2006 Kathan

FOREIGN PATENT DOCUMENTS

GB 2321866 A 8/1998
WO WO9835873 A1 8/1998

OTHER PUBLICATIONS

Feb. 2, 2008 PCT Written Opinion of ISA for PCT/US2008/054797.

* cited by examiner

*Primary Examiner*—David B Thomas
(74) *Attorney, Agent, or Firm*—Patrick K. Steele; Streets & Steele

(57) ABSTRACT

The apparatus of the present invention is directed to a replacement cage assembly (106) to modify a conventional power tong (100) to enable the power tong to grip and rotate smaller diameter tubular segments (90). The method of the invention is directed to modifying a power tong (100) to grip and rotate a tubular segment of a diameter smaller than could be gripped by the unmodified power tong (100). The invention provides a rotary gear insert (240), having an interior second cam surface, rotatably captured intermediate an upper cage plate (230) and a lower cage plate (210) and slidably receivable within the conventional rotary gear of the power tong (100) and to cam and rotate a plurality of replacement gripping jaws (220, 221) pivotally captured adjacent the second cam surface (240) and intermediate the upper cage plate (230) and the lower cage plate (210).

30 Claims, 12 Drawing Sheets

METHOD AND APPARATUS FOR FORMING TUBULAR CONNECTIONS

STATEMENT OF RELATED APPLICATION

This application depends from, and claims benefit of priority to, U.S. provisional application Ser. No. 60/891,329 filed on Feb. 23, 2007.

BACKGROUND

1. Field of the Present Invention

The invention relates to powered wrenches, and more specifically to power tongs to make-up and/or break-out threaded connections between adjacent tubular segments. In particular, the present invention is directed to an apparatus and method to modify a power tong to grip and rotate tubular segments having an expanded range of diameters.

2. Background of the Present Invention

Oil field tubular segments, e.g. drill pipe, production tubing and casing (hereafter referred to as "tubulars") are produced in segments that may be coupled ("made-up") using threaded connections at their ends to form tubular strings. Power tongs are used to make-up and/or to uncouple ("break-out") threaded tubular connections by gripping a first tubular with a back-up tong, and by gripping and rotating an adjacent, second tubular relative to the first tubular. Power tongs are typically hydraulically-powered devices, but may be, for example, pneumatically, electrically and/or mechanically driven.

FIG. 1A is a perspective view of one embodiment of a prior art power tong 100 that can be modified using a method and/or an apparatus of the invention. The embodiment of the power tong 100 in FIG. 1A may comprise a lifting member 20 to secure the power tong to a crane or hoist, a hydraulically-powered drive motor 15, and a gripping assembly 104 coupled to the drive motor 15 to grip and rotate a tubular (not shown in FIG. 1A).

The gripping assembly shown in FIG. 1A comprises a generally "C"-shaped gear housing 12 pivotally supporting a pair of hinged doors 14A, 14B to secure the bay, or opened (indicated by arrows 14A' and 14B') about hinges 18 using handles 16 to introduce a tubular into the bay 19.

The center of the bay 19 in FIG. 1A is generally intermediate a pair of opposed, pivotable gripping jaws 20, 21 (gripping jaw 21 not shown). Each gripping jaw may pivot between a retracted position and a gripping position about a pin or bolt 22. When cammed to the gripping position, the arcuate gripping faces 20C, 21C (gripping face 21C not shown in FIG. 1A) are displaced one toward the other to grip a tubular that may be introduced into the bay 19.

FIG. 1B is a perspective view of one embodiment of a prior art rotary gear 40 that can be rotatably disposed within the gear housing (element 12 of FIG. 1A) to cam the gripping jaws 20, 21 to grip a tubular received in the bay (see FIG. 1A). The rotary gear 40 is a generally "C"-shaped gear having slot 46A rotatably alignable with the throat 46 of the gear housing to receive a tubular into the bay 19. The rotary gear 40 in FIG. 1B further comprises a row of gear teeth 41 along its periphery to be driven by pinion gears, and an interior cam surface 44 to cam the gripping jaws from the retracted position to a gripping position. A "tooth," as that term is used herein (as singular form of "teeth"), is a engagement unit on or near the periphery of a rotary member, such as a gear, sprocket, or disc, that provides a generally non-slip means of engaging and rotating an adjacent rotary member.

The rotary gear of FIG. 1B may be rotatably secured within the gear housing 12 to surround the gripping jaws 20, 21 with the cam surface 44. The power tong 100 includes a rotary gear drive motor 15 (see FIG. 1A) to drive the plurality of pinion gears driving the teeth 41 and thereby transfer torque from the drive motor 15 to the rotary gear 40 (see FIG. 1B).

FIG. 2A is a cross-section plan view of the retracted gripping jaws 20, 21 of FIG. 1A surrounded by the cam surface 44 of the rotary gear of FIG. 1B after a tubular 90 is positioned within the bay 19 and between the gripping jaws 20, 21. The cross-section plane of FIG. 2A is through the gripping jaws 20, 21 and intermediate an upper cage plate and a lower cage plate described below in relation to FIG. 3. Gripping jaws 20, 21 are pivotable from their retracted position (see FIG. 2A) by powered rotation of cam surface 44 and rotary gear 40. Gripping jaws 20, 21 may be fitted with dies 30 to grip the tubular 90.

FIG. 2B is the cross-section plan view of FIG. 2A after clockwise rotation of rotary gear 40 through an angle to cam the cam rollers 20D, 21D from recesses 42 in the cam surface 44 of the rotary gear 40, and to thereby pivot the gripping jaws 20, 21 to grip the exterior of the tubular 90. Continued rotation of the rotary gear 40 within gear housing (see FIG. 1A) beyond the position shown in FIG. 2B cams gripping jaws 20, 21 into tighter engagement with the tubular 90 and rotates gripping jaws 20, 21, the cage plates that are coupled to the gripping jaws (described below in relation with FIG. 3) and the gripped tubular 90. Rotation of the rotary gear 40, the gripping jaws 20, 21 and the tubular 90 may continue until the threaded connection between the tubular 90 and the adjacent tubular (not shown in FIG. 2B) is broken out.

Breaking out a right-handed threaded connection using the power tong depicted in FIGS. 1A-2B requires counterclockwise rotation of the rotary gear 40 within the gear housing 12 to initially actuate the gripping jaws 20, 21 to engage the tubular 90. Continued counterclockwise rotation of the rotary gear 40 rotates tubular 90 to break-out a threaded connection between the tubular 90 and the adjacent tubular below the tubular 90 shown in FIGS. 2A and 2B.

It should be understood by those skilled in the art that the sequence of FIGS. 2A and 2B illustrate the gripping of a tubular 90 to break-out a right-handed connection or to make-up a left-handed threaded connection, and that FIG. 2B would be transposed to illustrate the movement of gripping jaws to make-up a right-handed threaded connection or to break-out a left-handed threaded connection.

FIG. 3 is an exploded perspective view of one embodiment of a prior art cage assembly that may be used in the power tong of FIG. 1A. The cage assembly 106 of FIG. 3 comprises a generally "C"-shaped upper cage plate 30 having a plurality of apertures to receive pins 22 or bolts 2 to secure upper cage plate 30 in a spaced-apart relationship to a generally "C"-shaped lower cage plate 10. The lower cage plate 10 and the upper cage plate 30 in FIG. 3, and the pins 22 and bolts 2, form a cage assembly pivotally securing gripping jaws 20, 21 within the cage assembly 106 with bolts 22. Gripping jaws 20, 21 in FIG. 3 each comprise a gripping face 20C, 21C to grip a portion of the exterior of a tubular introduced between the gripping jaws 20, 21. The gripping jaws 20, 21 in FIG. 3 each comprises a pin bore 20E, 21E to receive a pin 22, a pivot end 20A, 21A, a distal end 20B, 21B, and a cam follower 20D, 21D. Gripping jaws 20, 21 in FIG. 3 are shown in the retracted position within the cage assembly 106 to accept a tubular, and may be cammed by cam surface 44 of the rotary gear 40 (see FIGS. 2A and 2B) to pivot about pins 22 and displace gripping faces 20C, 21C to grip a tubular.

Cage assembly 106 may be positioned within and rotatable with the rotary gear 40 (see FIG. 1B) rotatable within gear housing 12 (see FIG. 1A). Each gripping jaw 20, 21 shown may comprise a cam roller or cam lobe 20D, 21D to rollably and/or slidably follow cam surface 44 of rotary gear 40 (see FIGS. 2A and 2B). Gripping faces 20C, 21C (gripping face 21C not shown in FIG. 3) of gripping jaws 20, 21 may be arcuate to correspond to the exterior of the tubular to be gripped. Optionally, dies 30, like those shown in FIGS. 2A and 2B, may be releasably disposed on gripping faces 20C, 21C to grip the external surface of a tubular 90 in the bay 19.

FIG. 4 is a perspective view of the assembled prior art cage assembly 106 of FIG. 3 vertically aligned with bay 19 of the gripping assembly 104 and positioned to be installed in the bay. Gripping assembly 104 in FIG. 4 provides a peripheral shoulder 5 generally surrounding the bay 19 and interrupted at the throat 46 of gear housing 12, and the shoulder 5 corresponds to a protruding lip 7 of cage assembly 106. FIG. 4 reveals cam surface 44 of the rotary gear 40 rotatably disposed within gear housing 12 and rotatable by operation of the drive motor 15.

FIG. 5 is a perspective view of the cage assembly 106 of FIG. 4 after installation within the bay 19 of the gripping assembly 104. Gripping jaws 20, 21 (gripping jaw 20 not shown) are in the retracted position to receive a tubular there between. Gripping jaws 20, 21 may be cammed by rotation of the rotary gear 40 to pivot gripping jaws 120, 21, one toward the other, to engage a tubular that may be received within the bay 19.

FIG. 6A is a plan view of the gripping assembly 104, and portions of the cage assembly 106 shown in FIG. 5, after a tubular 90 (shown in cross-section) is introduced through the throat 46 and into the bay 19 of the gripping assembly 104, and after the rotary gear 40 is rotated counterclockwise through a first angle to cam the gripping jaws 20, 21 to grip the tubular 90. Rotation of the rotary gear closes at least some of the throat 46. A portion of the peripherally protruding lip 7 of upper cage plate 30 (shown in FIGS. 4 and 5) is omitted from FIGS. 6A-6C to reveal the interaction between the cam followers 20D, 21D of the gripping jaws 20, 21 and the cam surface 44 of the rotary gear 40.

FIG. 6B is the top plan view of FIG. 6A after the rotary gear 40 is further rotated counterclockwise from the position shown in FIG. 6A to rotate the cage assembly 106 and the tubular 90 gripped by the gripping jaws 20, 21.

FIG. 6C is the plan view of FIGS. 6A and 6B after further counterclockwise rotation of the rotary gear 40 from the position shown in FIG. 6B to rotate the tubular 90. The rotary gear 40 maintains the angular position relative to the cage assembly 106 and tubular 90 in FIG. 6B. Rotation of the tubular 90 can continue until the threaded connection is made-up and the desired torque is applied to the connection between the tubular 90 and an adjacent tubular.

FIG. 7A is a plan view of a gripping assembly 104 of one embodiment of a prior art power tong comprising a rotary gear 40 rotatable within a gear housing 12. The rotary gear 40 in FIG. 7A comprises an interior cam surface 44 and a pair of generally opposed recesses 42, each to rollably or slidably receive and surrender a cam follower on a gripping jaw (not shown). Each recess 42 may positioned within the cam surface 44 to receive the follower 20D, 21D (see FIG. 2A-2B) when the slot in the rotary gear 40 is generally aligned with the throat 46 of the gear housing 12.

It should be understood that a prior art power tong may comprise a generally continuous rotary gear. For example, a prior art power tong may comprise a rotary gear that does not comprise a slot to facilitate the introduction of a tubular into the interior bay within the rotary gear. In these power tongs, the tubular to be gripped and rotated by the power tong can be introduced from above or below the power tong by longitudinal movement along its axis relative to the position of the power tong.

In one embodiment, a prior art power tong may have a continuous rotary gear. Additionally or alternatively, a prior art tong can include a continuous upper cage plate and a continuous lower cage plate in a spaced-apart relationship to the upper cage plate, and a plurality of gripping jaws movably secured intermediate the upper cage plate and the lower cage plate. It should be understood that the methods and apparatus described below and claimed herein may be used to make-up and/or break-out tubular connections, or may be used to modify a prior art power tong, of the type having a continuous rotary gear, upper cage plate and/or lower cage plate without departure from the spirit of the invention.

FIGS. 1A-7A are provided and described above to explain the structure and operation of a prior art power tong, and to provide a foundation to better support the disclosure of the invention, which is described below in relation to FIGS. 7B-11.

The shortcoming of the prior art power tong described above in relation to FIGS. 1A-7A is the limited range of diameters of tubulars that may be gripped and rotated to make-up and/or break-out threaded tubular connections. The gripping jaws 20, 21 of a conventional power tong like that described above may be movably secured, for example, pivoted, to grip only a limited range of tubulars, and the range may be limited by, for example, the radial length of grooves into which the gripping jaws are movably keyed, or, for a second example, the distance between the pins 22 that pivotally secure gripping jaws 20, 21 within the cage assembly 106, among other dimensions.

What is needed is a method and an apparatus that may be used to modify a conventional power tong so that it can be used to make-up and/or break-out an increased range of tubular diameters. What is needed is a method and an apparatus that can be used to make a conventional power tong adjustable to use on smaller diameters of tubulars. What is needed is a method and an apparatus to convert a conventional power tong to make-up or break-out threaded connections on tubulars having a diameters smaller than the smallest diameter that the conventional power tong can make-up or break-out without the use of the method and/or the apparatus.

SUMMARY OF THE PRESENT INVENTION

Embodiments of the invention provide an apparatus and a method that satisfies one or more of the above-described needs. Embodiments of the invention provide a method and a replacement cage assembly that may be used to modify a power tong so that it can be used to grip and rotate smaller diameters of tubulars. An embodiment provides a method of converting a conventional power tong so that it can be used to make-up or break-out a threaded connection between adjacent tubulars having a diameter smaller than the range of diameters for which the power tong was originally built. Embodiments of the invention substantially increase the range of tubular diameters for which a conventional power tong may be used.

The cam surface 44 of the rotary gear 40 shown in FIG. 7A may be adapted to receive and cooperate with a rotary gear insert, among other components, to substantially modify the gripping assembly 104 and to adapt it to grip and rotate tubulars of smaller diameters.

One embodiment of the apparatus provides a replacement cage assembly that may be used to modify a conventional power tong so that it can make-up and/or break-out a threaded tubular connection of a diameter smaller than the range of the unmodified power tong. One embodiment of the apparatus includes a replacement cage assembly that is receivable within the bay of a gripping assembly on a conventional power tong. The substitution of the replacement cage assembly may be implemented by capturing a rotary gear insert within the replacement cage assembly, and then by slidably installing the replacement cage assembly with the rotary gear insert positioned within the interior cam surface 44 of the original rotary gear of the gripping assembly, and by installing the replacement cage assembly, including a specially adapted pair of replacement gripping jaws movably secured, for example, pivotally secured therein, to substantially reduce the bay of the gripping assembly.

The apparatus comprises, in one embodiment, a pair of opposed gripping jaws movably secured, for example, pivotally secured, within replacement cage assembly adapted to be releasably installed within the bay of a gripping assembly of a conventional power tong. The apparatus and the method of modifying a conventional power tong can utilize the original rotary gear and drive motor of a conventional power tong to actuate and rotate the replacement cage assembly, and the invention saves rig time by allowing a quick "turndown" of a conventional power tong to handle smaller diameter tubulars.

The foregoing and other objects, features and advantages of the apparatus and method of the invention will be apparent from the following more particular description of a preferred embodiment, as illustrated in the accompanying drawings, FIG. 7B-11, wherein like reference numbers represent like parts of the invention.

BRIEF DESCRIPTION OF THE APPENDED DRAWINGS

FIG. 10 is a perspective view of the assembled cage assembly of FIG. 9 installed in the bay of the gripping assembly of the power tong, and with the replacement gripping jaws in the retracted position to receive a tubular there between.

DETAILED DESCRIPTION OF THE PRESENT INVENTION

Figure 1A:
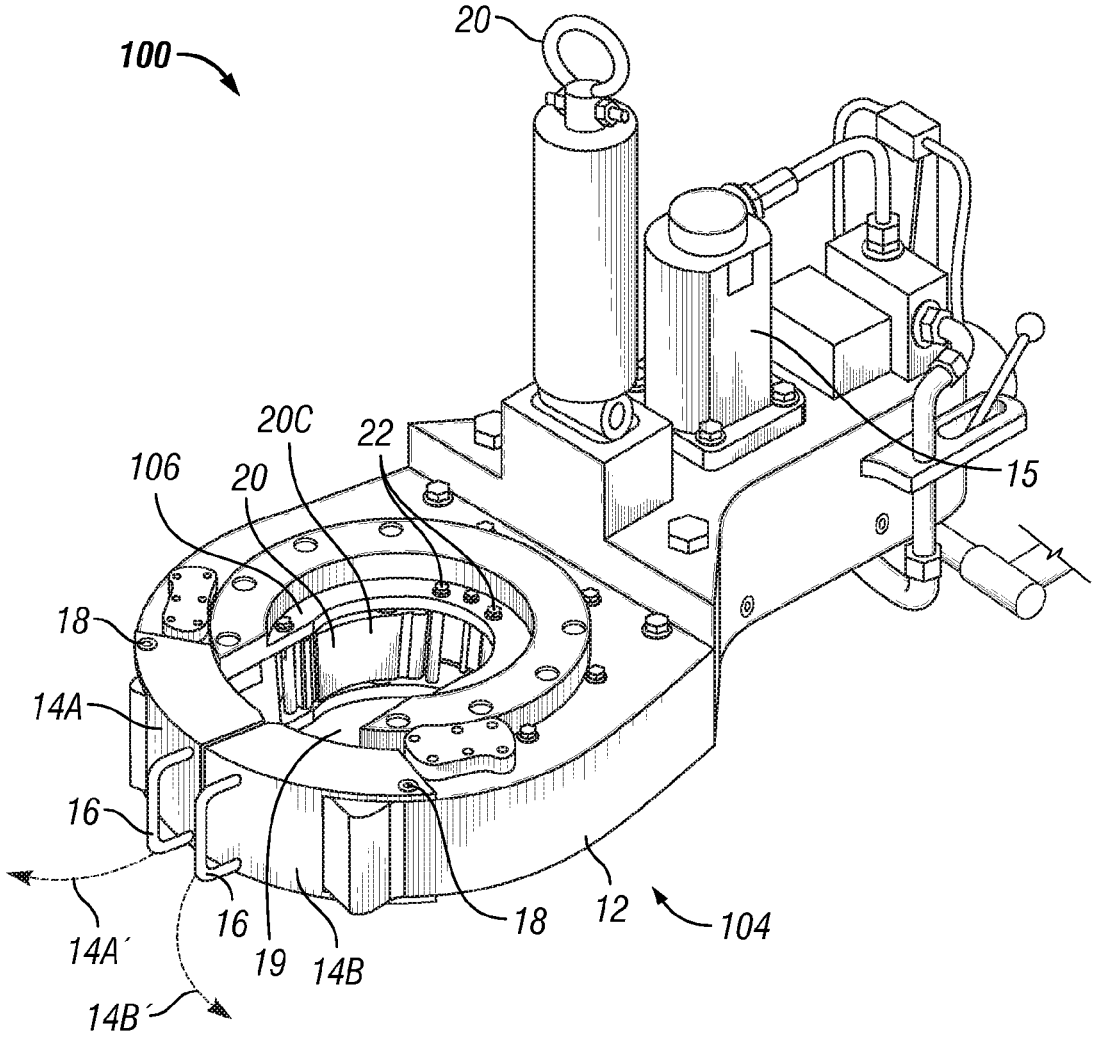
FIG. 1A (Prior Art)
FIG. 1A is a perspective view of an embodiment of a prior art power tong of the kind that can be modified using a method and/or an apparatus of the invention.
Figure 1B:
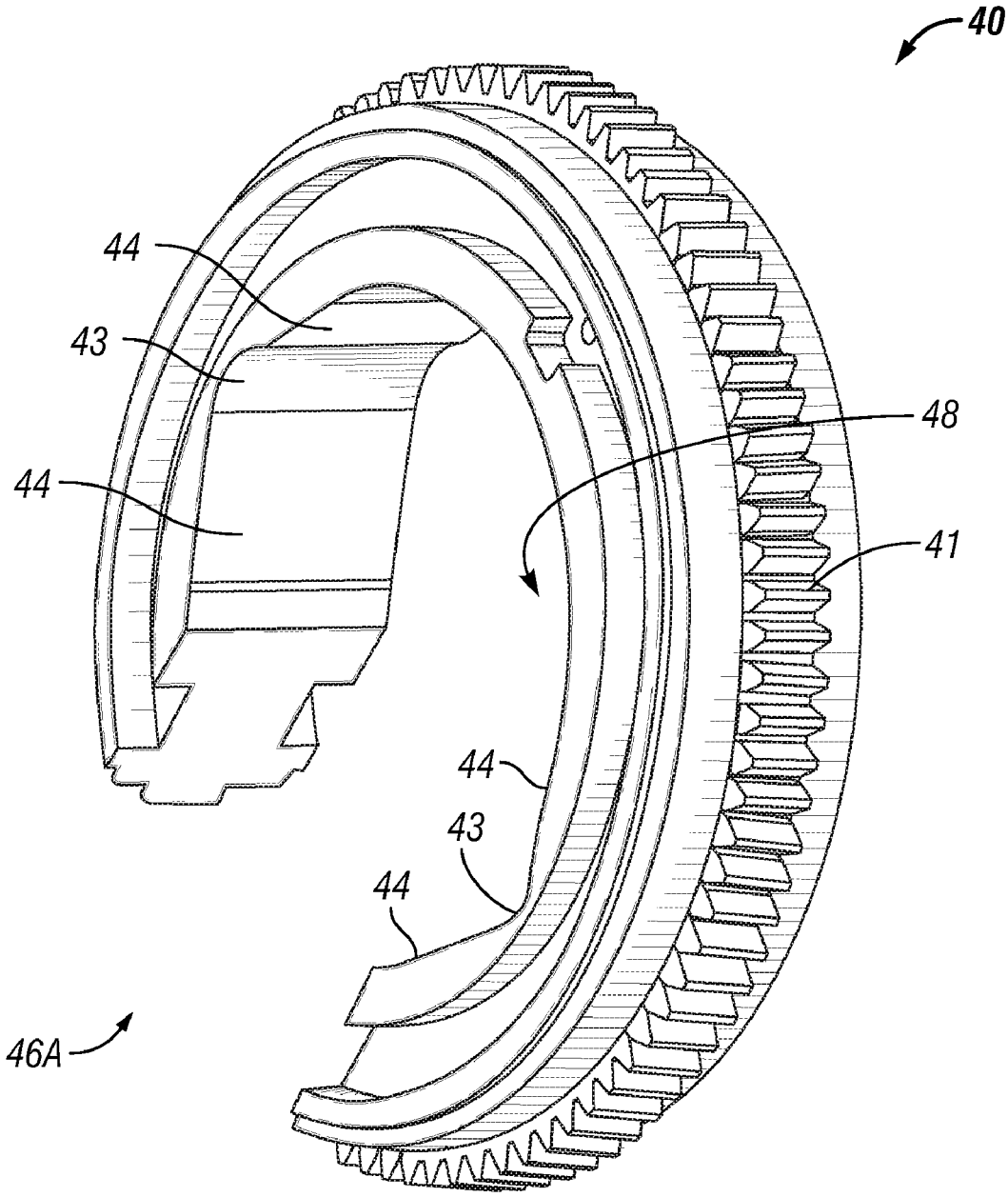
FIG. 1B (Prior Art)
FIG. 1B is a perspective view of a prior art rotary gear that can be rotatably disposed within the gear housing of the power tong shown in FIG. 1A.
Figure 2A:
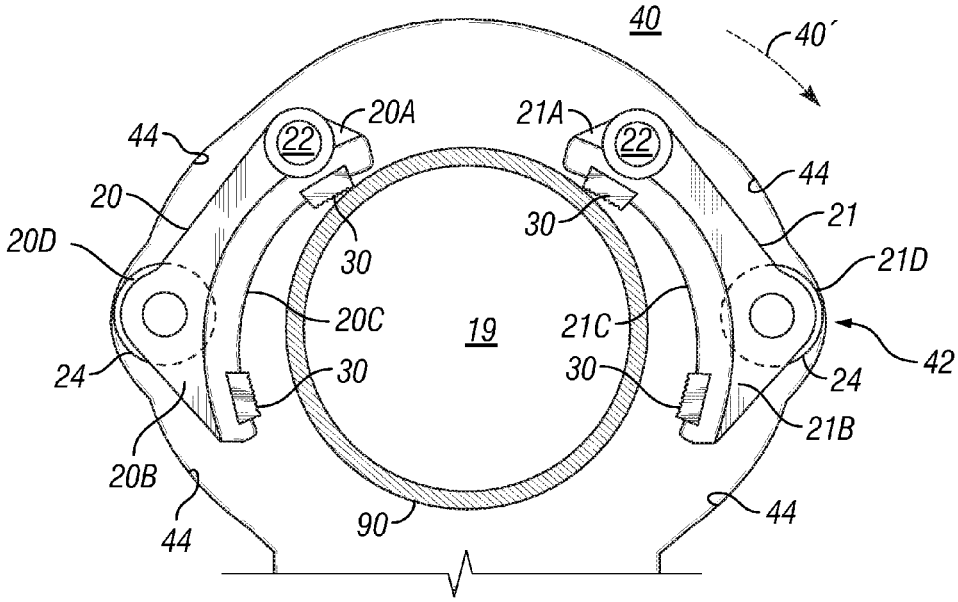
FIG. 2A (Prior Art)
FIG. 2A is a cross-section plan view of the movably secured gripping jaws of FIG. 1A and the interior cam surface of the rotary gear of FIG. 1B with the gripping jaws in the retracted position.
Figure 2B:
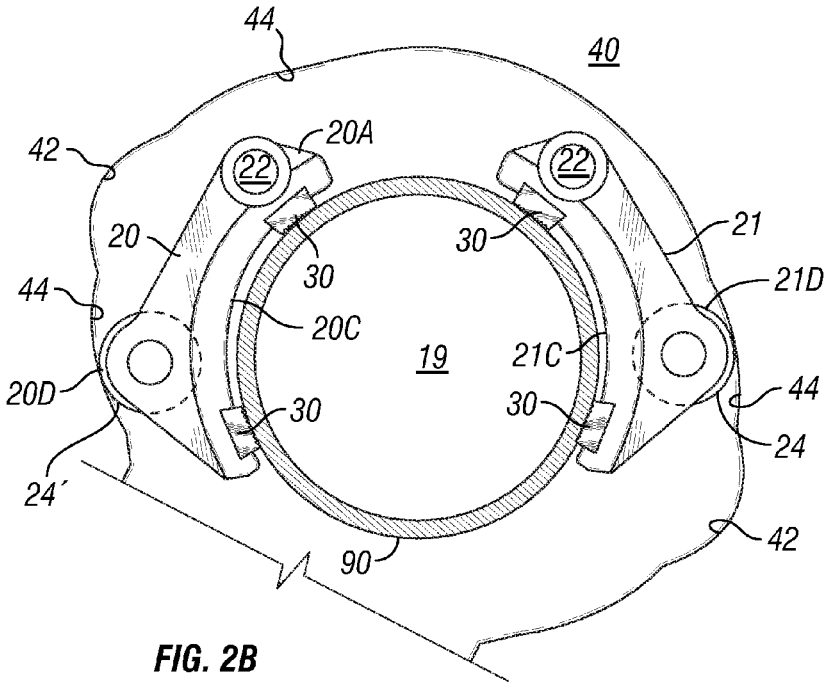
FIG. 2B (Prior Art)
FIG. 2B is a cross-section plan view of FIG. 2A after the gripping jaws are cammed to grip a tubular received within the bay of the power tong.
Figure 3:
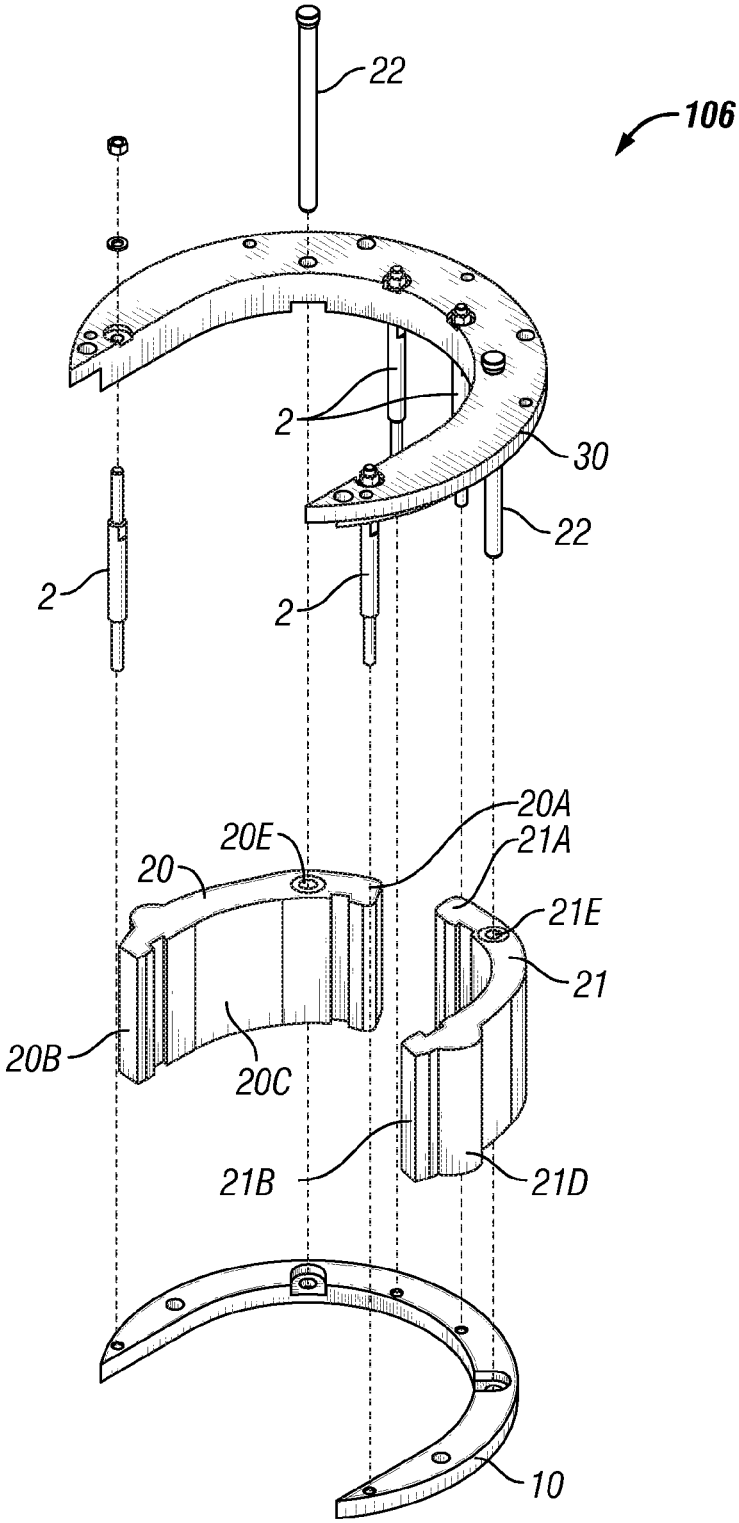
FIG. 3 (Prior Art)
FIG. 3 is an exploded perspective view of the original cage assembly of a conventional power tong.
Figure 4:
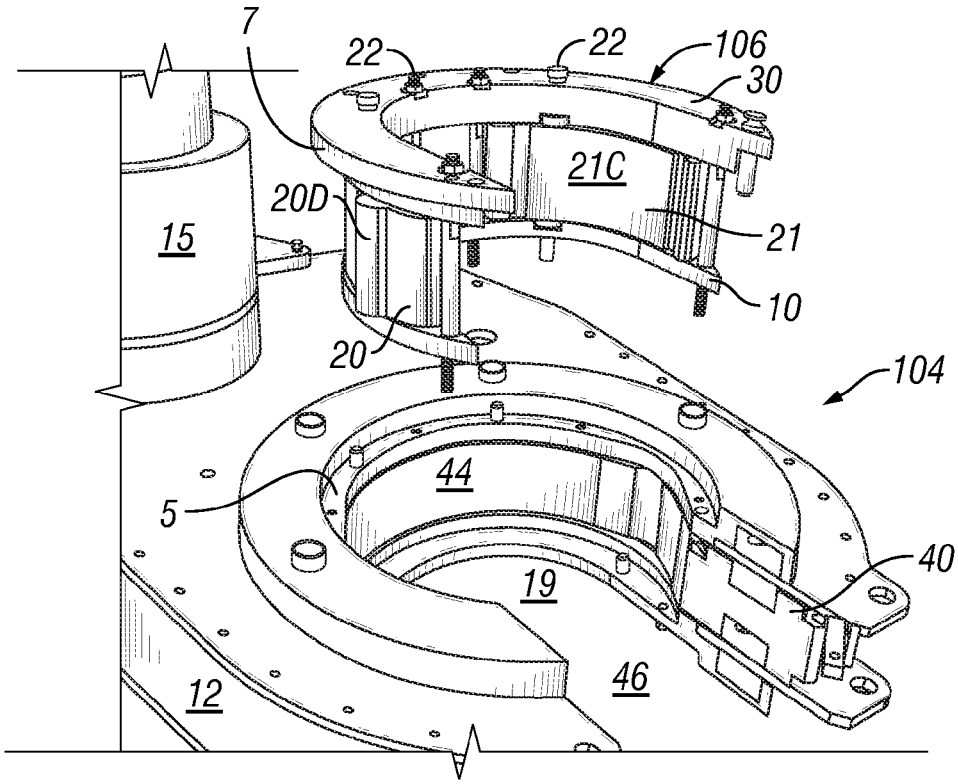
FIG. 4 (Prior Art)
FIG. 4 is a perspective view of the assembled conventional cage assembly of FIG. 3 vertically aligned with the bay of a gripping assembly of a power tong.
Figure 5:
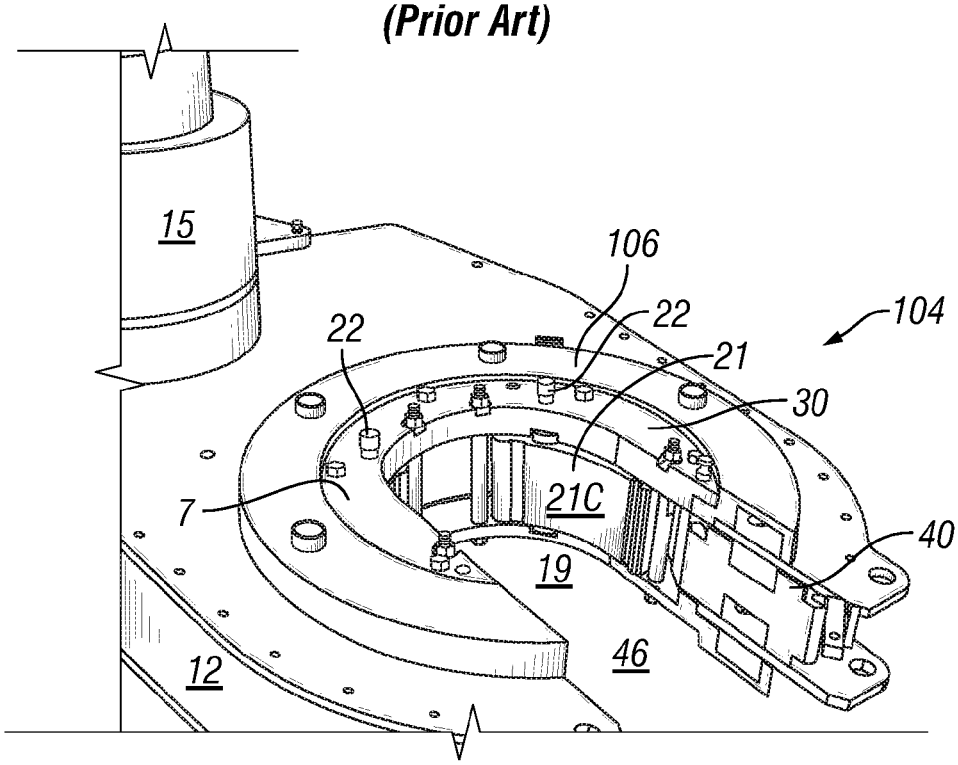
FIG. 5 (Prior Art)
FIG. 5 is a perspective view of the cage assembly of FIG. 4 slidably received within the power tong of FIG. 4, and in the open position to receive a tubular therein.
Figure 6A:
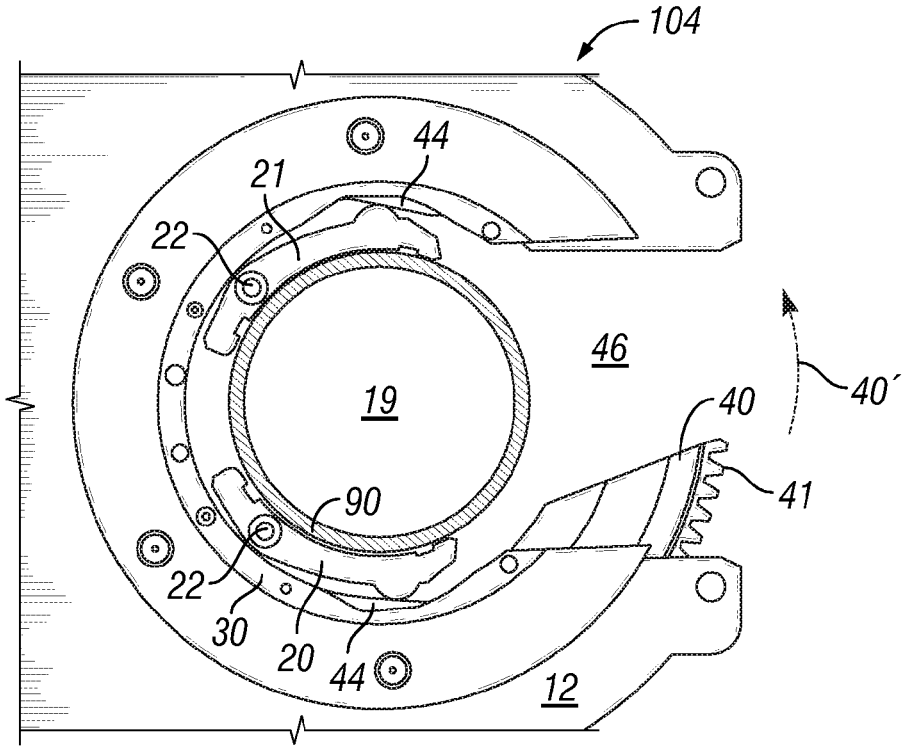
FIG. 6A (Prior Art)
FIG. 6A is a plan view of the power tong and cage assembly shown in FIG. 5 after rotation of the rotary gear counterclockwise from its original position to cam the gripping jaws to pivot to grip a tubular received within the bay of the gripping assembly of the power tong.
Figure 6B:
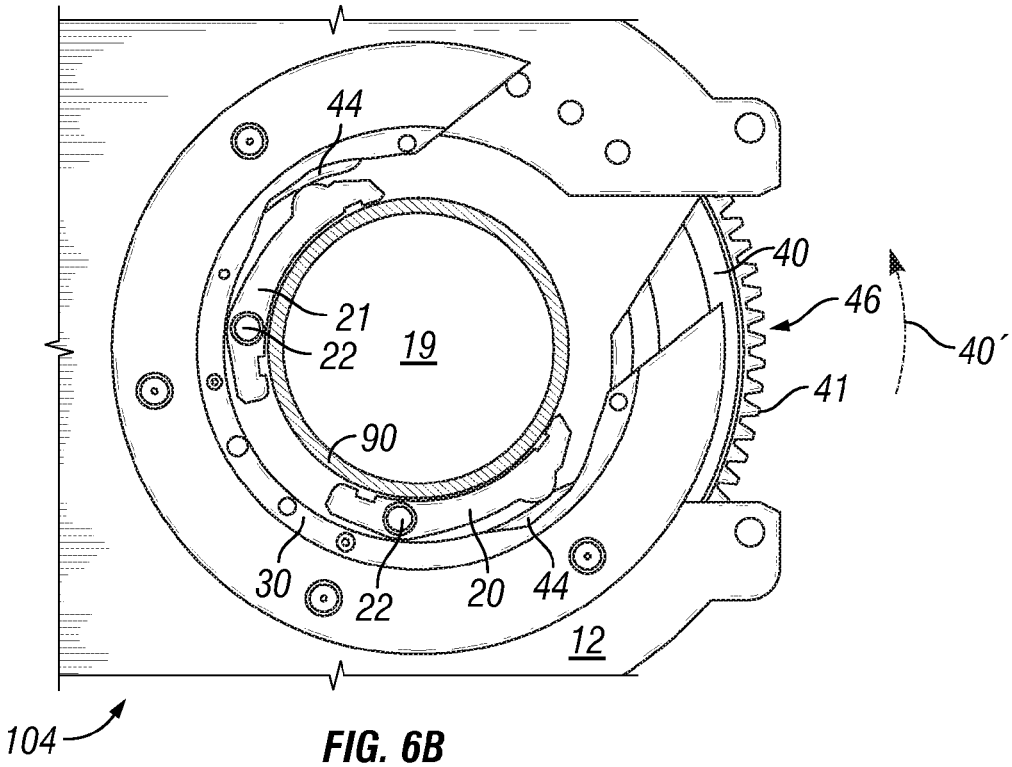
FIG. 6B (Prior Art)
FIG. 6B is the plan view of FIG. 6A after the cage assembly and the gripped tubular are rotated counterclockwise from the position shown in FIG. 6A.
Figure 6C:
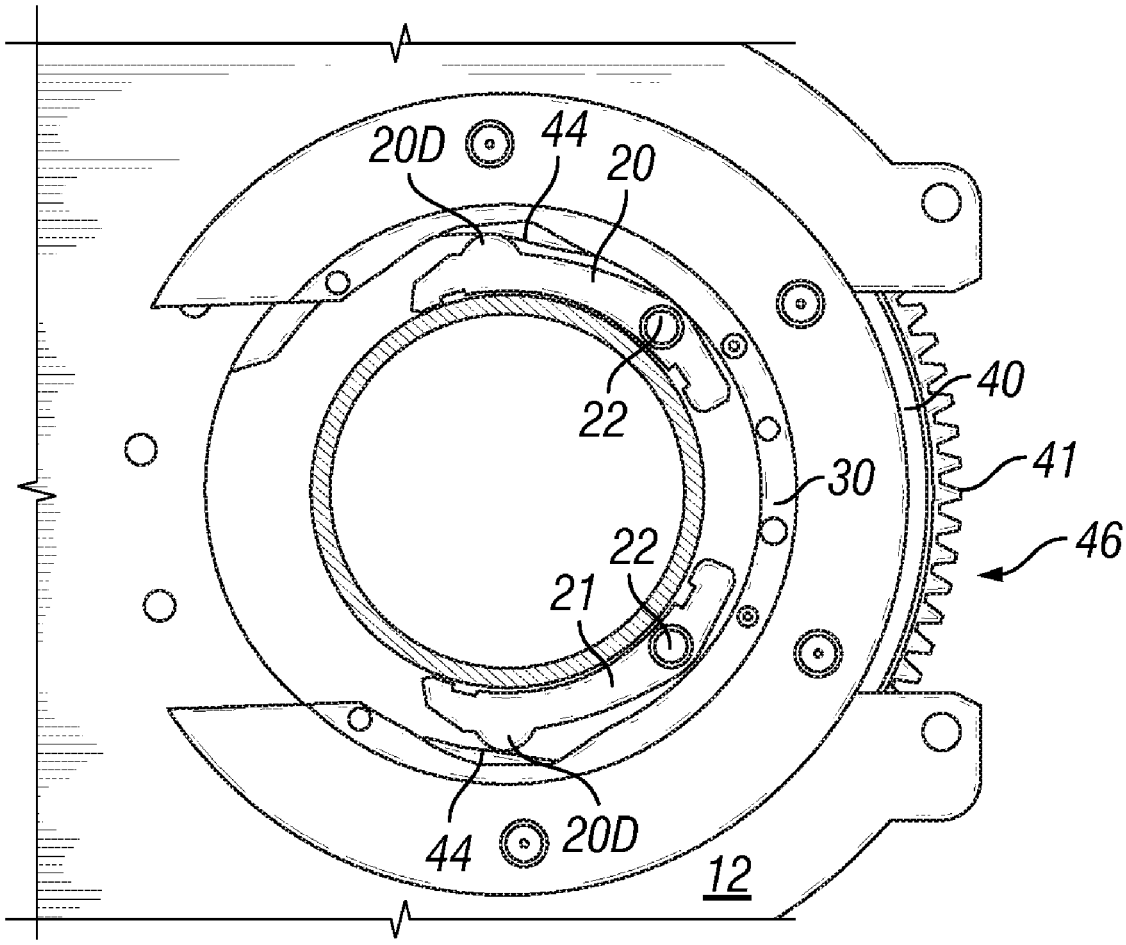
FIG. 6C (Prior Art)
FIG. 6C is the plan view of FIGS. 6A and 6B after the cage assembly and the gripped tubular are further rotated counterclockwise from the position shown in FIG. 6B.
Figure 7A:
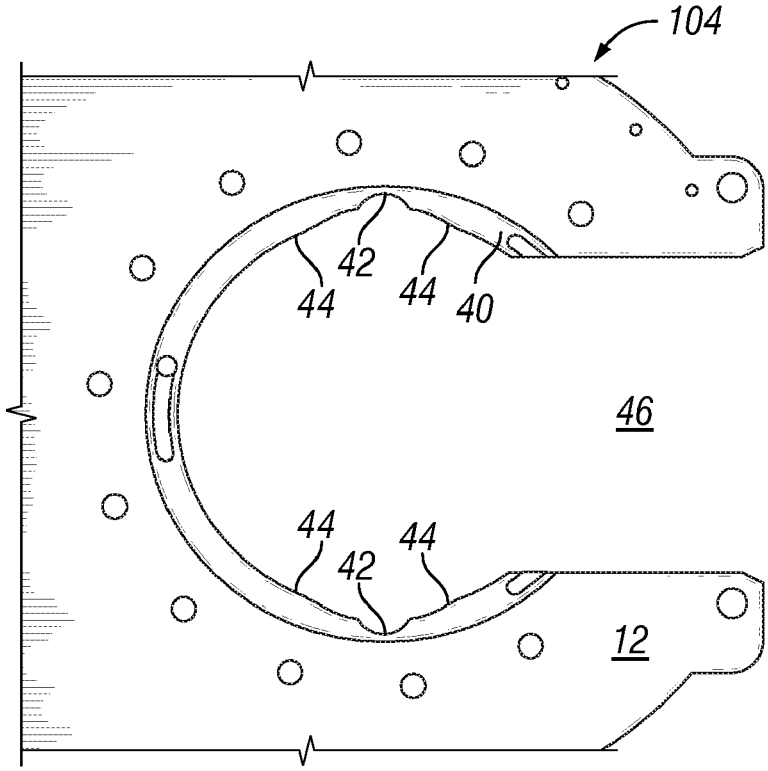
FIG. 7A (Prior Art)
FIG. 7A is a cross-section plan view of the rotary gear of FIG. 1B rotatably received with a gear housing.
Figure 7B:
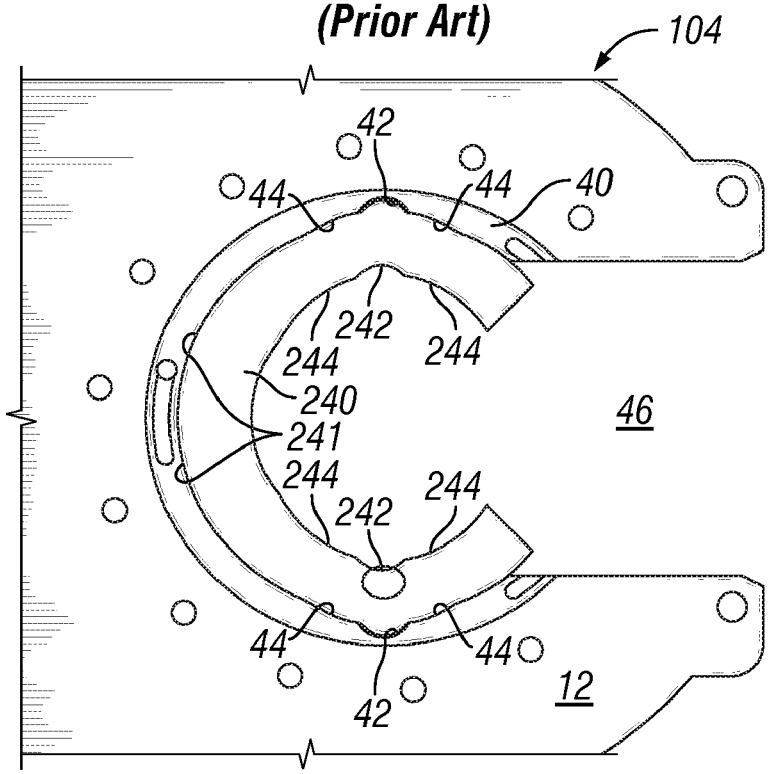
FIG. 7B is the cross-section plan view of an embodiment of a rotary gear insert releasably received and secured within the interior of a conventional power tong rotary gear of FIG. 7A.

FIG. 7B is the plan view of the rotary gear 40 and gripping assembly 104 shown in FIG. 7A after a rotary gear insert 240 is releasably received within the interior cam surfaces 44 of the rotary gear 40. The rotary gear insert 240 depicted in FIG. 7B comprises an outer surface 241 to engage the cam surface 44 of the rotary gear 40 to substantially prevent rotation of the insert 240 within the rotary gear 40. The interior of insert 240 may comprise one or more generally opposed recesses 242, each within cam surface 244, to receive and surrender cam followers, such as rollers and/or lobes, on the replacement gripping jaws movably disposed, in this case, pivotably disposed, within the replacement cage assembly, an embodiment of which is described below in relation to FIGS. 8 and 11.

Figure 8:
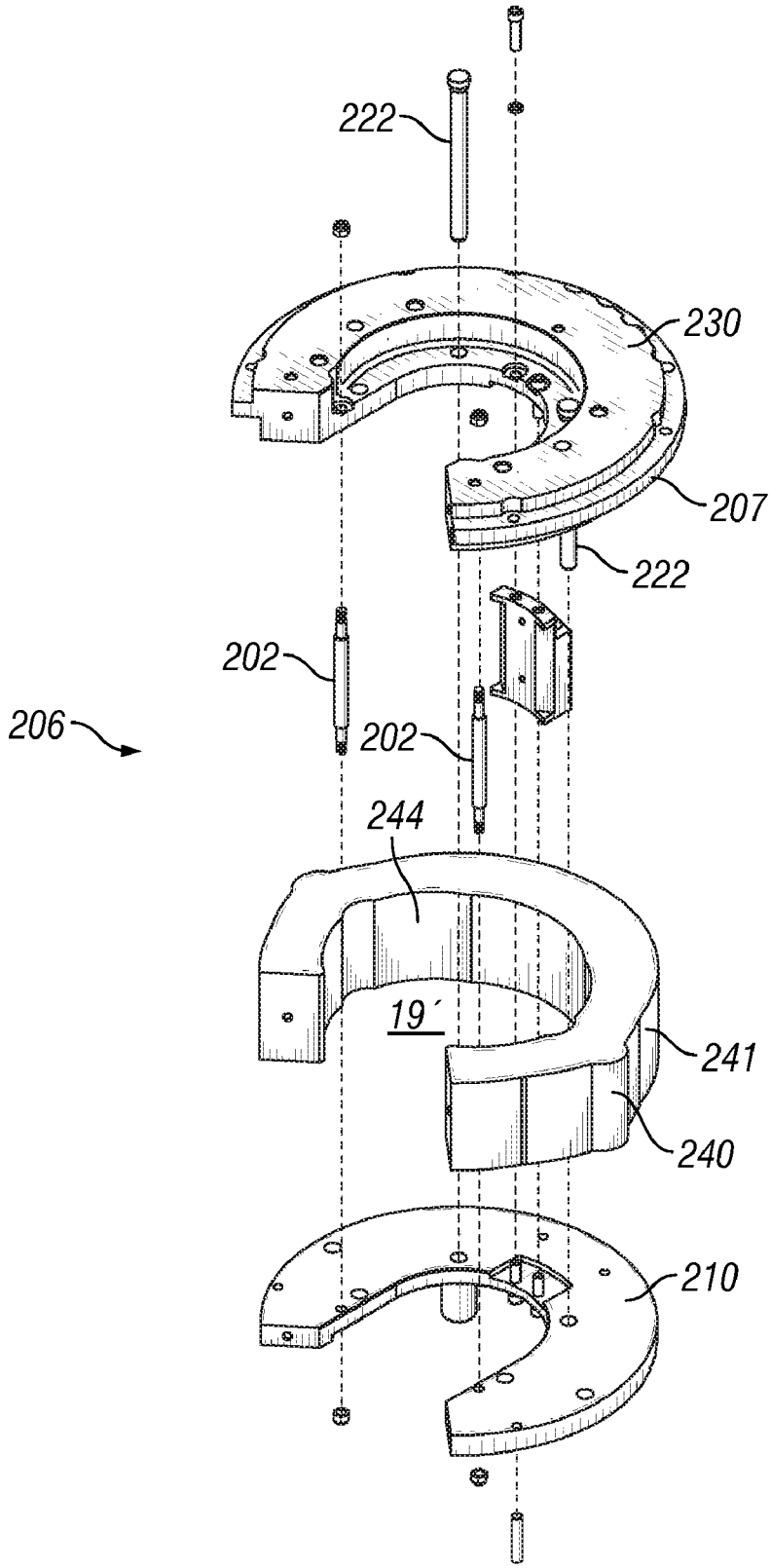
FIG. 8 is a perspective exploded view of one embodiment of the rotary gear insert in relation to the other components of the replacement cage assembly.

FIG. 8 is an exploded view of one embodiment of a replacement cage assembly 206. The upper cage plate 230 comprises a plurality of apertures to receive bolts 202 and/or pins 222. The bolts 202 and/or pins 222 may comprise shoulders to provide the desired separation of the upper cage plate 230 to maintain it in a spaced-apart relationship with and from the lower cage plate 210, and to pivotally capture two replacement gripping jaws 220, 221 (omitted from FIG. 8—see FIG. 9) intermediate the upper cage plate 230 and the lower cage plate 210, and within the interior bay 19' of the rotary gear insert 240. The rotary gear insert 240 is rotatably captured intermediate the upper cage plate 230 and the lower cage plate 210. The upper cage plate 230 may comprise a protruding lip 207 to support the replacement cage assembly 206 within the bay 19 (not shown in FIG. 8).

Figure 9:
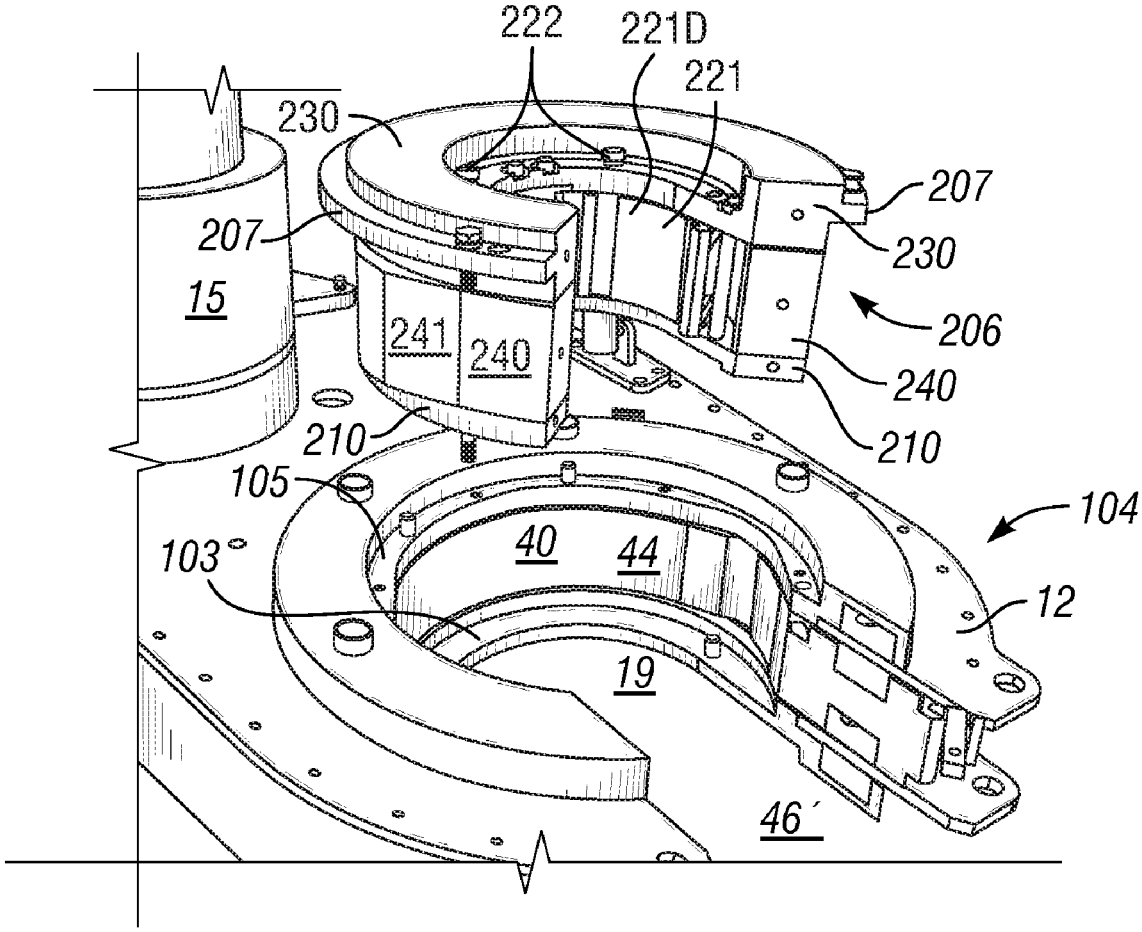
FIG. 9 is a perspective view of the assembled replacement cage assembly of FIG. 8 after installation of replacement gripping jaws within the interior of the rotary gear insert, and after alignment of the assembled replacement cage assembly with the bay of a power tong.

FIG. 9 is a perspective view of the assembled replacement cage assembly 206 of FIG. 8 after replacement gripping jaws 220, 221 are positioned within the interior of the rotary gear insert 240 and pivotally captured on pins 222, and the assembled replacement cage assembly 206 is vertically aligned with the bay 19 of the gripping assembly 104 of the conventional power tong. The peripherally protruding lip 107 depicted in FIG. 9 is aligned to be received and supported by supporting shoulder 105 of the gripping assembly 104. The rotary gear insert 240 disposed between the upper cage plate 230 and the lower cage plate 210 of the cage plate assembly 104 is aligned to be received within the interior cam surface 44 of rotary gear 40. Optionally, an additional supporting shoulder 103 may be disposed on the gear housing 12 of the gripping assembly 104 to support the lower cage plate 210 upon installation of the replacement cage assembly 206.

Figure 10:
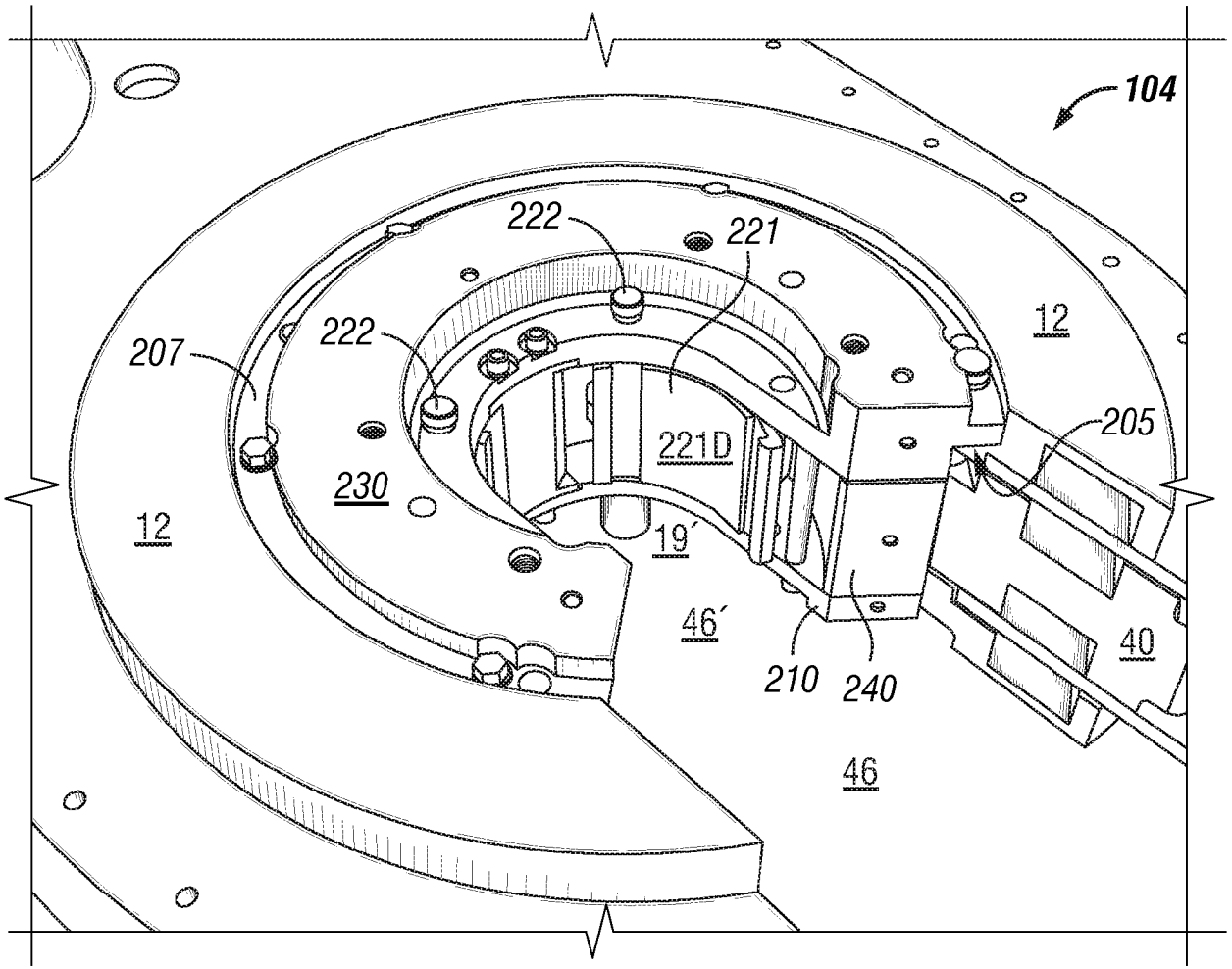

FIG. 10 is a perspective view of the replacement cage assembly 206 and the gripping assembly 104 of FIG. 9 after the replacement cage assembly 206 is installed and supported within the bay 19 at the protruding lip 207 by the peripheral shoulder 105 and/or peripheral shoulder 103 (not shown). The modified gripping assembly 104 of FIG. 10 is in the open position to receive a tubular through the throat 46 and the substantially narrower throat 46' of the replacement cage assembly 206. The rotary gear insert 240 of the replacement cage assembly 206 is received within and rotatable by the rotary gear 40. Powered rotation of the rotary gear 40 will rotate the rotary gear insert 240 within the replacement cage assembly 206 to cam gripping jaws 220, 221 (gripping jaw 220 not shown in FIG. 10) one toward the other to grip a tubular (not shown) received within the substantially reduced bay 19'.

Figure 11:
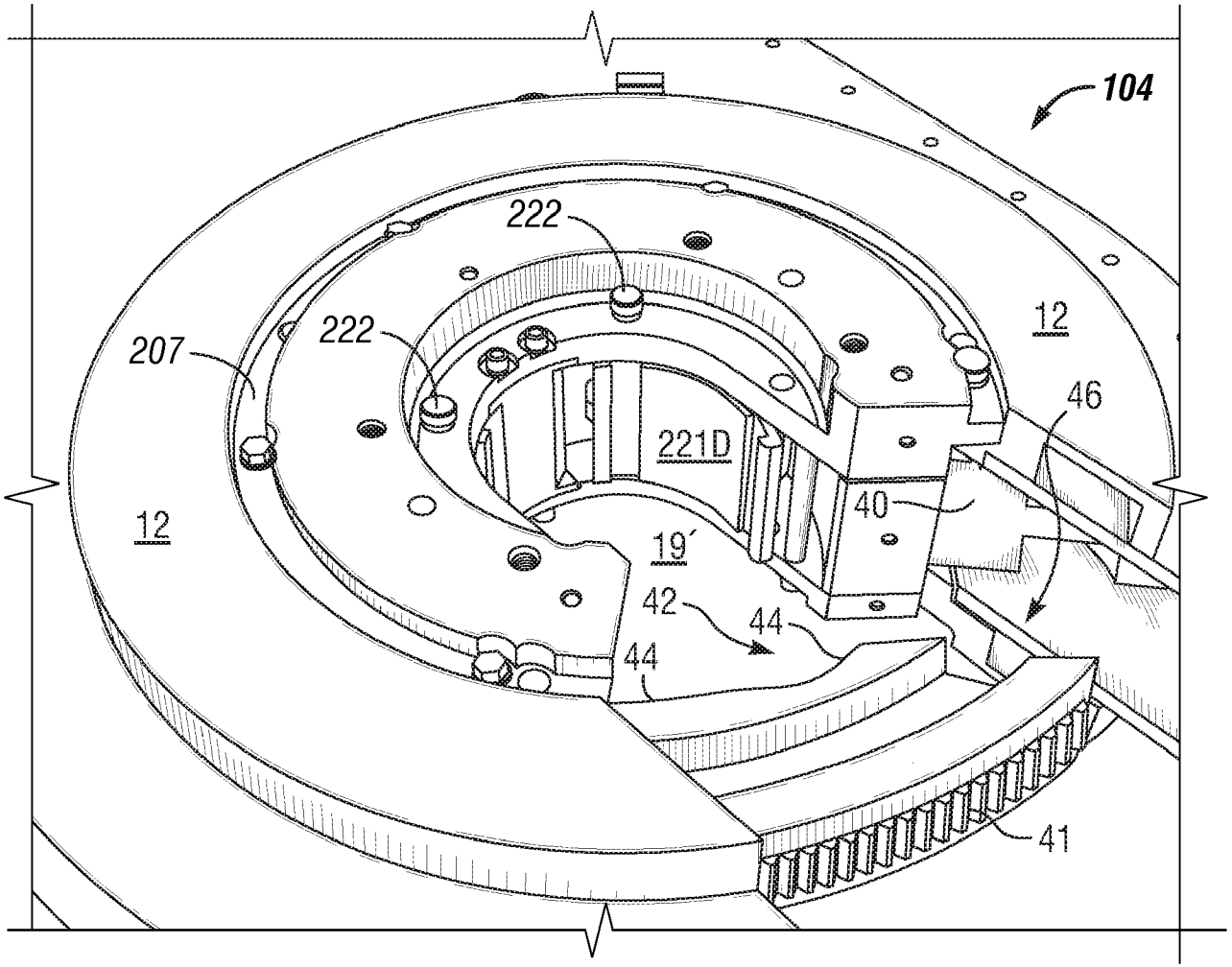
FIG. 11 is the perspective view of FIG. 10 after the rotary gear and the rotary gear insert are rotated through an angle relative to the upper cage plate and the lower cage plate to cam and to pivot the replacement gripping jaws, one toward the other.

FIG. 11 is a perspective view of the embodiment of the gripping assembly 104 of FIG. 10 after counterclockwise rotation of the rotary gear 40 and the rotary gear insert 240 to cam gripping jaws 220, 221 one toward the other. A tubular disposed within the substantially reduced bay 19' may be gripped by rotation of rotary gear 40 and the rotary gear insert 240 to cam gripping jaws 220, 221, and then rotated with rotation of the rotary gear 40 and the replacement cage assembly 206 to make-up and/or break-out a threaded tubular connection between the gripped tubular and an adjacent tubular.

It should be understood that the interactions of the components of the present invention described above can be readily reversed to provide break-out threaded connections between adjacent tubulars, and the interior cam surface 244 of the rotary gear insert 244 is adapted to make-up a threaded connection by rotation of the replacement cage assembly 206 in a first direction, and to break-out a threaded connection by rotation of the replacement cage assembly 206 in the reverse direction. Recesses 242 of the rotary gear insert 240 in FIG. 7B provide pivoting engagement of gripping jaws 220, 221 upon the initial rotation of the rotary gear insert 240 (and the rotary gear 40 in which it is received) in either the first direction or the second, reverse direction. It should be understood that rotation of the rotary gear 40, and of the rotary gear insert 240 received therein, in either the first or the reversed direction will cam the gripping jaws 220, 221 into engagement with the exterior of a tubular received within the bay 19'. Once the tubular is gripped, further rotation of the rotary gear 40 and the rotary gear insert 240, and also the remaining components of the replacement cage assembly 206, will rotate the tubular to make-up or break-out the threaded connection between the tubular and an adjacent tubular.

Gripping jaws 220, 221 may comprise dies, inserts, pads, coatings or other devices secured to, disposed on or integrated with their gripping faces 221D, 221D to enhance the grip of the gripping jaws 220, 221 on the exterior of the tubular or to protect the tubular. Non-marking devices or materials may be used to prevent damage of the tubular surface.

It should be understood by those skilled in the art that the gripping jaws of a replacement cage assembly may be movably secured intermediate the upper cage plate and the lower cage plate, and/or in a manner other than pivotally secured like the gripping jaws shown in the appended FIGS. 7B-11. For example, but not by way of limitation, a gripping jaw may be slidably secured, e.g., intermediate the upper cage plate and the lower cage plate by slidable insertion of an upper key within an upper channel in the upper cage plate and slidable insertion of a lower key within a lower channel within the lower cage plate that generally corresponds to the upper channel in the upper cage plate. Other embodiments may comprise gripping jaws movably secured intermediate an upper cage plate and/or lower cage plate using other couplings to movably secure the gripping jaws, e.g., intermediate the upper cage plate and the lower cage plate to move between a retracted position and at least one deployed position according to the movement of the rotary gear insert.

The method and/or the use of the replacement cage assembly described above may include the use of one or more integral or separate back-up tong(s) to grip and/or resist rotation of an adjacent tubular being coupled to, or uncoupled from, the tubular gripped and rotated using the method or the replacement cage assembly.

A pivoting gripping jaw may have a cam follower, including, but not limited to, a contoured lobe or a roller, to engage and follow cam surface 244 of the rotary gear insert 240 and to deploy the gripping jaws 220, 221. In one embodiment, the inwardly disposed surface of the rotary gear insert 244 has two or more generally distributed or opposed recesses 242, each recess 242 to receive and surrender a follower of a pivoting gripping jaw 220, 221 upon powered rotation of the rotary gear 40 relative to the upper cage plate 230 and the lower cage plate 210 of the cage assembly 206 to deploy the gripping jaws 220, 221 inwardly to engage the tubular.

It should be understood that the rotary gear insert 240 may be slidably received in and secured against rotation within the rotary gear 40 by, but not limited to, friction, protrusions on the radially outwardly disposed surface of the rotary gear insert 240 that are receivable into corresponding recesses 42 within the interior cam surface 44 of the rotary gear 40, or by one or more protrusions or backing lugs (not shown) on the radially inwardly disposed cam surface 44 of the rotary gear that are receivable into one or more corresponding recesses (not shown) in the radially outwardly disposed outer surface 241 of the rotary gear insert.

The embodiments described herein each provide a method to modify a conventional power tong to make-up and/or break-out threaded tubular connections smaller than the range of the unmodified power tong. One embodiment of the method may include the step of modifying a power tong by installing a replacement cage plate assembly comprising a pair of opposed pivoting gripping jaws and a generally "C"-shaped rotary gear insert generally rotatably surrounding the gripping jaws. Another embodiment of the method includes the steps of installing the replacement cage assembly to position a rotary gear insert within the interior of an existing rotary gear of the power tong to substantially reduce the area of the bay defined by the interior of the rotary gear containing the rotary gear insert, and then rotating the rotary gear and the rotary gear insert within the gear housing to pivotally deploy gripping jaws of the replacement cage assembly to their gripping position to engage a tubular. A method may also include the step of rotating the rotary gear and the replacement cage assembly, including the rotary gear insert, and the tubular to make-up and/or break-out a threaded connection between the tubular and an adjacent tubular.

In one embodiment, the rotary gear insert deploys the gripping jaws to grip the tubular, and the gripping jaws become trapped in a self-tightening configuration between the cam surface 244 of the rotary gear insert 240 and the tubular. Subsequently, with continued rotation of the rotary gear 40, the upper cage plate 230 and lower cage plate 210, above and below the rotary gear insert 240, respectively, begin to rotate with the rotary gear insert 240 and the rotary gear 40 of the gripping assembly 104.

The terms "comprising," "including," and "having," as used in the claims and specification herein, shall be considered as indicating an open group that may include other elements not specified. The term "consisting essentially of," as used in the claims and specification herein, shall be considered as indicating a partially open group that may include other elements not specified, so long as those other elements do not materially alter the basic and novel characteristics of the claimed invention.

The terms "a," "an," and the singular forms of words shall be taken to include the plural form of the same words, such that the terms mean that one or more of something is provided. For example, the phrase "a gripping jaw comprising two sides" should be read to describe a gripping jaw having two or more sides.

The terms "at least one" and "one or more" are used interchangeably. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

We claim:

1. A power tong to grip and rotate a first tubular relative to a second tubular, comprising:

a gear housing;

a rotary gear rotatably received within the gear housing and rotatable within a plane about an axis, the rotary gear comprising teeth to engage at least one drive gear, a first cam surface disposed within an interior of the rotary gear disposed about the axis; and a replacement cage assembly comprising:

a rotary gear insert comprising a radially outwardly disposed surface, having a periphery exceeding about 180 degrees, received within the interior of the rotary gear, the rotary gear insert having a second cam surface disposed within the interior of the rotary gear insert;

at least one gripping jaw pivotally disposed within the interior of the rotary gear insert;

wherein the second cam surface engages and displaces the at least one gripping jaw inwardly to grip and rotate the first tubular relative to the second tubular; and wherein a torque is transferred from the at least one drive gear to the rotary gear through the teeth, and the torque is transferred from the rotary gear to the rotary gear insert at an interface between the radially outwardly disposed surface of the rotary gear insert and the interior of the rotary gear.

2. The power tong of claim 1 wherein the replacement cage assembly further comprises:

an upper cage member; and a lower cage member coupled to the upper cage member in a spaced-apart relationship to the upper cage member, the rotary gear insert movably disposed there between;

wherein the at least one gripping jaw is pivotally coupled intermediate the upper cage member and the lower cage member.

3. The power tong of claim 2 wherein the upper cage member comprises a protruding lip received and supported on a first shoulder of the power tong.

4. The power tong of claim 2 further comprising a second shoulder of the power tong to support the lower cage member.

5. The power tong of claim 2 wherein the interior of the rotary gear, the interior of the rotary gear insert, an interior of the upper cage member and an interior of the lower cage member are aligned along the axis.

6. The power tong of claim 2 wherein the upper cage member is an upper cage plate and the lower cage member is a lower cage plate.

7. The power tong of claim 1 wherein the second cam surface of the rotary gear insert comprises at least one recess to receive and surrender at least one cam follower to position the at least one gripping jaw between a retracted position and a gripping position.

8. The power tong of claim 7 wherein the radially outwardly disposed surface of the rotary gear insert further comprises at least one protrusion received into the at least one recess in the interior of the rotary gear.

9. The power tong of claim 1 wherein the replacement cage assembly is axially installed in and removed from the power tong.

10. The power tong of claim 1 wherein the rotary gear insert is indirectly coupled to the at least one drive gear through the rotary gear of the power tong.

11. A replacement cage assembly to modify a power tong to grip and rotate a tubular, comprising:

a rotary gear insert receivable within an interior of a rotary gear rotatably coupled to the power tong, the rotary gear insert comprising:

an interior;

a radially outwardly disposed surface with a periphery exceeding about 180 degrees and receivable within the interior of the rotary gear; and cam surface to engage and cam at least one gripping jaw radially inwardly to grip and rotate a tubular introduced into the interior of the rotary gear insert and positioned adjacent the at least one gripping jaw;

wherein the interior of the interior of the rotary gear has a profile generally complimentary to, and extending at least about 180 degrees about, the radially outwardly disposed surface of the rotary gear insert receivable therein to facilitate the transfer of a torque from the rotary gear to the rotary gear insert.

12. The replacement cage assembly of claim 11 wherein the rotary gear insert comprises at least one protrusion to be received within at least one recess in the rotary gear of the power tong.

13. The replacement cage assembly of claim 11 further comprising:

an upper cage member; and a lower cage member coupled in a spaced relationship to the upper cage member;

wherein the rotary gear insert is movably disposed intermediate the upper cage member and the lower cage member.

14. The replacement cage assembly of claim 13 wherein the upper cage member is an upper cage plate and the lower cage member is a lower cage plate.

15. A method of using a power tong, having a rotary gear rotatable in a plane about an axis, to grip and rotate a first tubular, the method comprising the steps of:

providing a rotary gear insert having a radially outwardly disposed surface with a periphery exceeding about 180 degrees about the axis and received within a generally complimentary interior of the rotary gear, the rotary gear insert further comprising an interior having a cam surface;

movably securing at least one gripping jaw within the interior of the rotary gear insert adjacent to the cam surface;

disposing the first tubular within the interior of the rotary gear insert and generally adjacent the gripping jaw;

transferring a torque through the rotary gear to the rotary gear insert disposed within the interior of the rotary gear to rotate the rotary gear insert about the axis and through a first angular displacement to move the at least one gripping jaw into engagement with the first tubular; and continuing to transfer the torque to rotate the rotary gear insert about the axis to rotate the first tubular.

16. The method of claim 15 wherein the movably securing step comprises:

movably securing two gripping jaws within the interior of the rotary gear insert adjacent to the cam surface.

17. A method of modifying a power tong having a rotary gear having an interior to receive a rotary gear insert, the rotary gear being rotatable within a plane about an axis, comprising the steps of:

providing a rotary gear insert, having an interior and a radially outwardly disposed surface with a periphery exceeding about 180 degrees and a profile complimentary to a profile of the interior of the rotary gear;

pivotally disposing a plurality of gripping jaws within the interior of the rotary gear insert to be cammed radially inwardly by angular displacement of the rotary gear insert about the axis; and moving the rotary gear insert along the axis to install the rotary gear insert within the complimentary interior profile of the rotary gear.

18. The method of claim 17 further comprising the steps of:

providing an upper cage member; and providing a lower cage member in a spaced-apart relationship to the upper cage member;

wherein the rotary gear insert is movably disposed intermediate the upper cage member and the lower cage member; and wherein the at least one gripping jaw is pivotably disposed intermediate the upper cage member and the lower cage member, and within the interior of the rotary gear insert.

19. The method of claim 18 further comprising the step of:

disposing a protruding lip on the upper cage member; and seating the protruding lip of the upper cage member on a shoulder of the power tong to support the replacement cage plate assembly at a position within the power tong.

20. The method of claim 18 wherein the step of providing an upper cage member comprises providing an upper cage plate, and the step of coupling a lower cage member to the upper cage member in a space-apart relationship to the upper cage plate comprises coupling a lower cage plate to the upper to the upper cage plate in a spaced-apart relationship to the upper cage plate.

21. A replacement cage assembly to modify a power tong having a rotary gear rotatable within a plane about an axis, the replacement cage assembly comprising:

a rotary gear insert, comprising an interior having a radially inwardly disposed cam surface and a radially outwardly disposed surface with a periphery exceeding about 180 degrees about the axis; and a plurality of gripping jaws pivotally disposed within the interior of the rotary gear insert;

wherein the replacement cage plate assembly is installable in the power tong by moving the rotary gear insert along the axis to install the rotary gear insert within a generally complimentary profile of the interior of the rotary gear; and wherein a torque may be transferred through the rotary gear to the rotary gear insert at an interface spanning at least about 180 degrees and disposed between the interior of the rotary gear and the radially outwardly disposed surface of the rotary gear insert.

22. The replacement cage assembly of claim 21 further comprising:

an upper cage member and a lower cage member coupled in a spaced-apart relationship to the upper cage member;

wherein the rotary gear insert is movably disposed intermediate the upper cage member and the lower cage member.

23. The replacement cage assembly of claim 22 wherein the upper cage member is an upper cage plate and the lower cage member is a lower cage plate.

24. The replacement cage assembly of claim 22 further comprising:

at least one pin coupled to the upper cage member; and to the lower cage member, and pivotally coupled to a gripping jaw therebetween.

25. The replacement cage assembly of claim 22 further comprising:

a lip protruding radially outwardly from the upper cage member to seat on a shoulder on the power tong upon installation of the rotary gear insert within the interior of the rotary gear.

26. The replacement cage assembly of claim 21 wherein the rotary gear insert further comprises one or more recesses within the radially inwardly disposed cam surface to receive and surrender a cam follower.

27. The replacement cage assembly of claim 26 wherein the cam follower comprises a wheel.

28. The replacement cage assembly of claim 21 wherein the rotary gear insert comprises a protrusion ion on a radially outwardly disposed surface to be received within a recess within the interior of the rotary gear of the power tong.

29. The replacement cage assembly of claim 28 wherein the cam follower comprises a lobe.

30. The replacement cage assembly of claim 21 wherein the number of gripping jaws is two.

* * * * *

UNITED STATES PATENT AND TRADEMARK OFFICE

CERTIFICATE OF CORRECTION

PATENT NO. : 7,621,202 B2
APPLICATION NO. : 12/036145
DATED : November 24, 2009
INVENTOR(S) : Vernon J. Bouligny and Joshua Kyle Bourgeois It is certified that error appears in the above-identified patent and that said Letters Patent is hereby corrected as shown below:

Col. 10 lines 44-45 in claim 11, please remove the phrase "of the interior" from the wherein clause:

"wherein the interior of the interior of the rotary gear has a profile generally complimentary to, and..."

to read:

"wherein the interior of the rotary gear has a profile generally complimentary to, and..."

Signed and Sealed this

Twentieth Day of July, 2010

David J. Kappos

David J. Kappos
*Director of the United States Patent and Trademark Office*